US006531418B1

(12) United States Patent
Lidar et al.

(10) Patent No.: US 6,531,418 B1
(45) Date of Patent: Mar. 11, 2003

(54) PAPERMACHINE CLOTHING

(75) Inventors: Per-Ola Lidar, Hogsjo (SE); Goran Nohlgren, Hogsjo (SE); Jorgen Johansson, Hogsjo (SE)

(73) Assignee: Voith Fabrics Heidenheim GmbH & Co. KG, Heidenheim (DE)

( * ) Notice: Subject to any disclaimer, the term of this patent is extended or adjusted under 35 U.S.C. 154(b) by 0 days.

(21) Appl. No.: 09/284,980

(22) PCT Filed: Nov. 7, 1997

(86) PCT No.: PCT/GB97/03060

§ 371 (c)(1),
(2), (4) Date: Jul. 16, 1999

(87) PCT Pub. No.: WO98/21403

PCT Pub. Date: May 22, 1998

(30) Foreign Application Priority Data

Nov. 8, 1996 (GB) ..... 9623403
Jun. 25, 1997 (GB) ..... 9713309

(51) Int. Cl.[7] ..... B32B 5/26; B32B 27/12; B32B 3/10; D03D 9/00

(52) U.S. Cl. ..... 442/35; 442/43; 442/49; 442/57; 428/137; 428/138

(58) Field of Search ..... 442/35, 43, 49, 442/57, 366; 428/137, 138

(56) References Cited

U.S. PATENT DOCUMENTS

| | | | | | |
|---|---|---|---|---|---|
| 4,503,113 | A | * | 3/1985 | Smart | 428/234 |
| 5,071,697 | A | * | 12/1991 | Gulya et al. | 428/234 |
| 6,027,615 | A | * | 2/2000 | Davenport et al. | 162/358.2 |

FOREIGN PATENT DOCUMENTS

| | | |
|---|---|---|
| EP | 0 307 183 | 3/1989 |
| EP | 0 413 869 | 2/1991 |
| EP | 0 440 076 | 8/1991 |
| GB | 2 202 873 | 10/1988 |
| GB | 2 235 705 | 3/1991 |
| WO | 92/17643 | 10/1992 |

* cited by examiner

*Primary Examiner*—Elizabeth M. Cole
*Assistant Examiner*—Ula C. Ruddock
(74) *Attorney, Agent, or Firm*—Caesar, Rivise, Bernstein, Cohen & Pokotilow, Ltd.

(57) ABSTRACT

Papermachine clothing comprises a base cloth consisting of a layer of woven fabric and/or a layer of thermoplastics material in mesh form. A batt fiber layer containing a non woven array of yarns extending in the intended machine direction of the papermachine clothing.

20 Claims, 3 Drawing Sheets

PAPERMACHINE CLOTHING

The invention concerns papermachine clothing, and has particular, although not exclusive, reference to clothing for use in the press section of a papermaking machine.

Conventionally, press felts comprise a woven base cloth providing adequate strength in the running direction of the felt and one or more compressible fibre layers applied thereto as, for example, by needling.

Base cloths of the conventional kind are expensive to manufacture and, furthermore, can give rise to the incidence of marking of the paper as it passes through the press section of the papermaking machine due to the presence of knuckles formed at the cross-over points of the warp and weft yarns which form the base cloth.

WO 92/17643 describes a press felt comprising a base cloth made from two superimposed layers of plastics mesh. A batt of fibres is secured to one side of the base cloth by needling. A variation of this felt which has gone into production comprises a base cloth laminate of a plastics mesh with a woven cloth. A batt of staple fibre is needled to the base cloth. Papermachine clothing of this type is prone to delamination particularly when used in press sections of higher-speed papermaking machines where hard press nips are present. This is because the high shear forces resulting from the combination of high-loaded press rolls and the high-speed of the travelling felt tends to cause delamination particularly between the mesh membrane and the woven fabric.

The present invention seeks to provide papermachine clothing, particularly, but not exclusively, for use in the press section of a papermaking machine which is not as susceptible to delamination as these known structures and yet still minimises marking of the paper web supported thereon.

According to the present invention there is provided papermachine clothing comprising a base cloth and a batt fibre layer, said base cloth comprising, at least in part, thermoplastic material in mesh form, wherein said batt fibre layer contains a non woven array of yarns extending in the intended machine direction of the papermachine clothing.

The base cloth preferably comprises at least one layer of woven fabric in combination with at least one layer of thermoplastics material in mesh form The thermoplastics material in mesh form is preferably of the type as described in GB 2202873 and GB 2235705. When a combination of woven and nonwoven mesh material forms the base cloth, the batt and nonwoven array of yarns substantially improves the resistance to delamination between the woven fabric and thermoplastic membrane mesh layer of the base cloth due to the better interlocking of the reinforcing yarns of the batt with the remainder of the fabric. When the base cloth solely comprises mesh membrane material the absence of a woven element to the base cloth eliminates the time consuming complicated and expensive weaving step. Resistance to felt compaction is improved by the use of the mesh membrane and flat parallel nonwoven yarns in the batt layer, the latter presenting a larger contact surface area compared with woven structures when pressure is focussed at the knuckles of the yarn crossover points increasing the likelihood of marking.

It is noted that a non woven array of yarns may also be provided in the batt layer in the cross machine direction in addition to the yams provided in the machine direction. This improves the cross machine direction rigidity of the felt.

The layers of the papermachine clothing are preferably bonded together by needling at least one batt layer of staple fibre onto at least one side of the base cloth.

At least some and preferably all of the reinforcing non woven array of yarns provided in the batt layer are preferably straight and thus non crimped. Prior art non crimped yarn structures in felts have always offered the advantage of providing a greater pressure contact area. Therefore a more uniform press force is exerted on the supported paper web, providing enhanced dewatering with reduced marking tendency. In contrast a woven structure will contain crimped yarns and the pressure is then transmitted to the paper web via the fabric knuckles only. Hence dewatering is more localised, leading to a greater marking tendency. The downside of previous fabrics containing straight yarns is that they lack resilience and the fabrics compact more quickly, resulting in poor dewatering performance. The presence of a nonwoven mesh and the provision of the nonwoven array of yarns in the batt layer on the paper side of the nonwoven mesh together offer vastly improved resistance to compaction and therefore longer working life compared with previous felts containing straight, non crimped yarns.

The reinforcing yarns in the batt preferably comprise a monofilament, multifilament, or twisted cabled yarn (monofilament and/or multifilament component) which may be at least partially encapsulated in and/or may be at least partially impregnated with polymer. Twisted monofilament yarns are preferred. This polymer preferably comprises one or more of the following: polyurethane (e.g. thermoplastic polyurethane), polyester or copolyester, polyamide or copolyamide, silicone or thermoplastic elastomer. The yarns of the non-woven array are preferably coated with an elastomeric polymer, particularly when the optional thermoplastics mesh layer is not present.

The yarns in the batt fibre layer may be prepared by laying elastomer, TPU, coated yams such as monofilaments, multifilaments, cabled yarns or twisted yarns, into profiled grooves in a roll or plate and then apply ultrasonic energy and pressure, separately or simultaneously to the yams to deform the coating material. The cooled yams will preferably have a flat profile, although any shape is possible. This improves the pressure distribution properties of the batt fibre layer into which the yarns are incorporated, improving felt compaction resistance and reducing marking. Noncoated yams may also be deformed by this technique.

It is noted that materials susceptible to heat degradation, eg. nylon or polyolefins, can be used as core yarns. Connecting members may be formed between yarns of an array to form a membrane like mesh, making the non woven array of yams easier to handle when incorporating into the strips of batt fibre material.

The batt preferably comprises one or more nylon fibre materials, optionally with different dtex values. The batt fibres may be predominantly orientated in the machine direction or cross-machine direction, or they may be randomly orientated. The weight of the batt layer(s) is preferably in the range from 300 to 800 $g/m_2$. The dtex range of the batt fibres is ideally in the range from 3 to 70 dtex.

It is noted that the woven layer or layers and the mesh membrane layer or layers may be provided in any arrangement. Typically the layer comprising the batt and non woven array of yarns is secured in place by first needling the batt to the base cloths, typically to a mesh membrane component of the base cloth, and subsequently or simultaneously one or more reinforcing yarns are needled into the batt strip.

The mesh membrane component of the base cloth preferably includes at least one, and ideally a plurality, of load bearing yarns in the machine direction lands thereof. If more than one mesh membrane is provided, ideally, the layers have different mesh sizes. The woven component layer or layers of the base cloth may comprise any weave.

In order that the present invention may be more readily understood specific embodiments thereof will now be described by way of example only with reference to the accompanying drawings in which.

Figure 1:
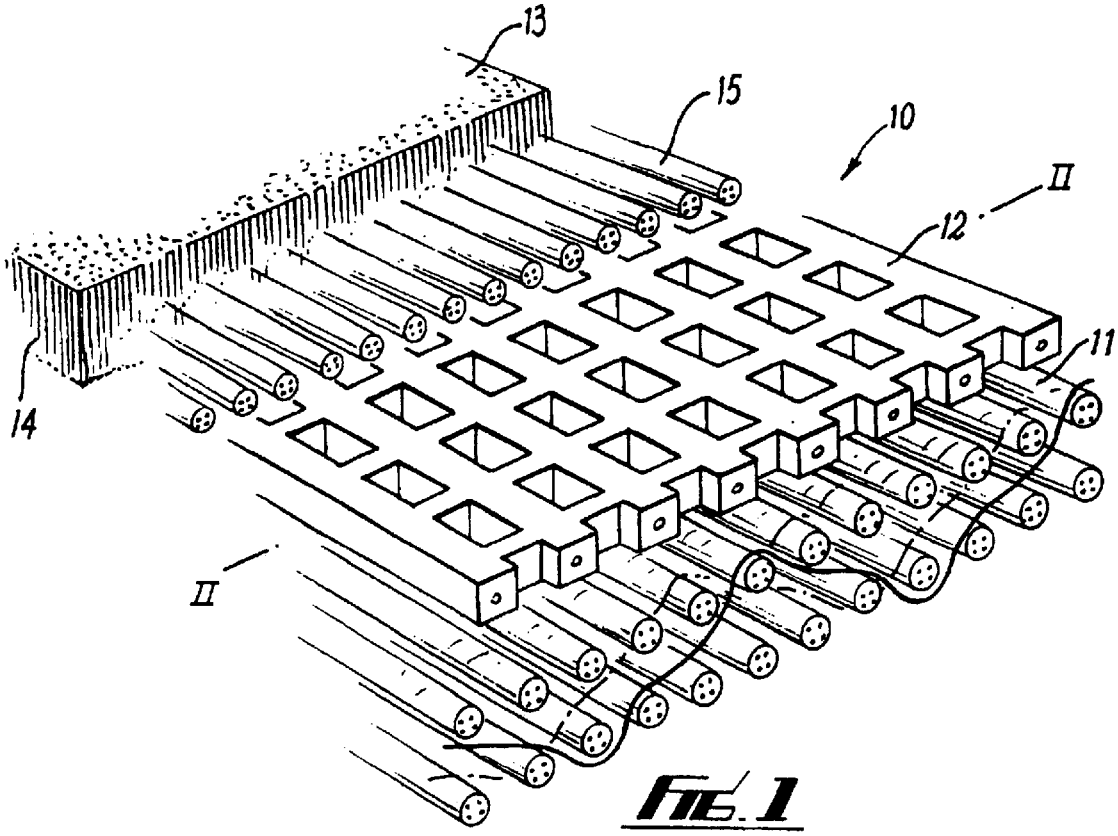
FIG. 1 is a perspective view of one fabric made in accordance with the invention.
Figure 2:
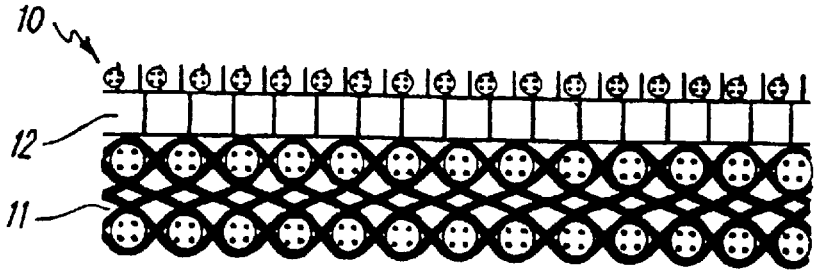
FIG. 2 is a transverse section edge along the line II—II of FIG. 1.

Referring now to FIGS. 1 and 2, papermachine clothing 10, particularly for use as a press felt for a papermaking machine, comprises a woven base cloth 11 with two layers of machine direction yams bound together with a cross machine direction yarn system. The base cloths further comprises a moulded mesh membrane 12 which is manufactured from synthetic thermoplastics material. The longitudinally extending, machine direction, land areas of the mesh have a reinforcing yarns extending therethrough. Typically the mesh openings of the mesh will give an open area of 30 to 60% and will each be in the range of 0.4 to 1.5 $mm^2$. These openings are typically square or rectangular, but may be of any other shape.

The batt layer 13 of the papermachine clothing consists of a batt of synthetic fibrous material 14 that contains a plurality of non-crimped reinforcing yarns 15. These reinforcing yarns extend in the machine direction of the fabric. The reinforcing yarns comprise multifilaments fully encapsulated in an elastomeric thermoplastic polymer material.

The fabric as illustrated in FIGS. 1 and 2 is made by arranging the two layers of the base cloths in a stacked fashion and needling the batt layer onto them. The batt reinforcing yarns may be secured in position during this needling operation or may subsequently be secured in position by needling.

Figure 3:
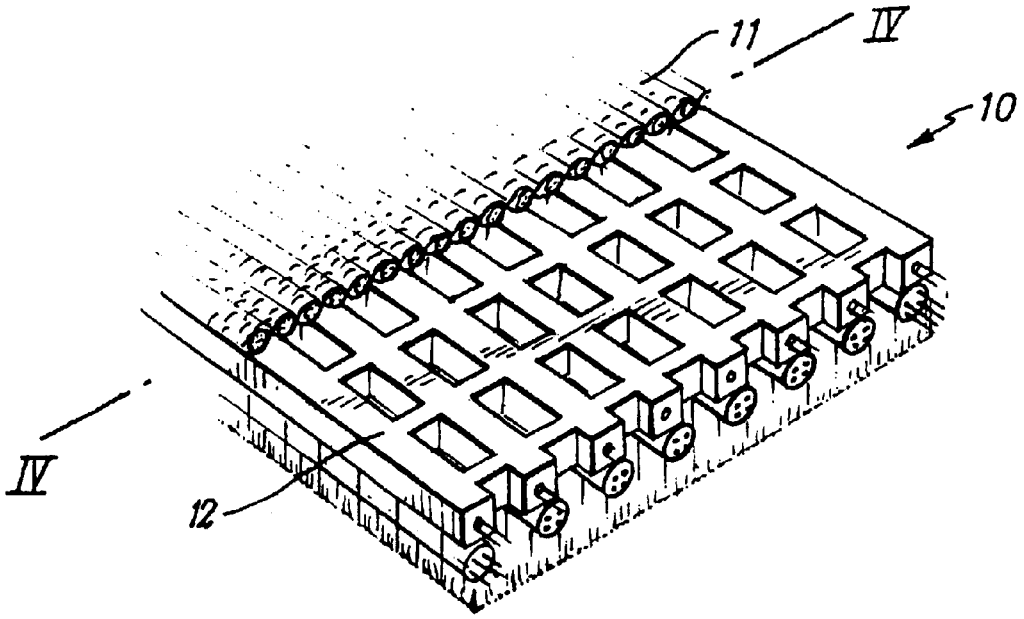
FIG. 3 is a perspective view of a second fabric in accordance with the invention.
Figure 4:
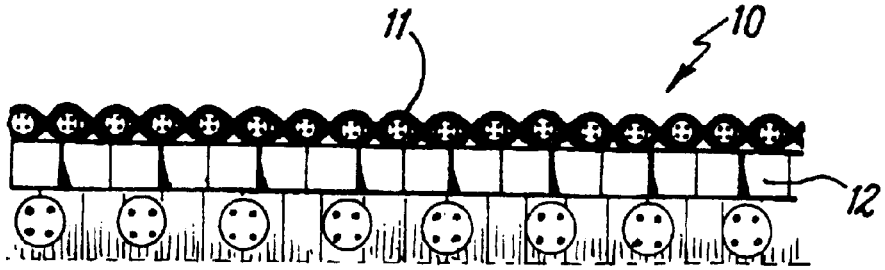
FIG. 4 is a transverse section along the line IV—IV of FIG. 3.

Referring to FIGS. 3 and 4 a second embodiment of the invention is illustrated which is similar to that illustrated in FIGS. 1 and 2 except in that the weave pattern of the woven element 11 of the base cloth is different.

Figure 5:
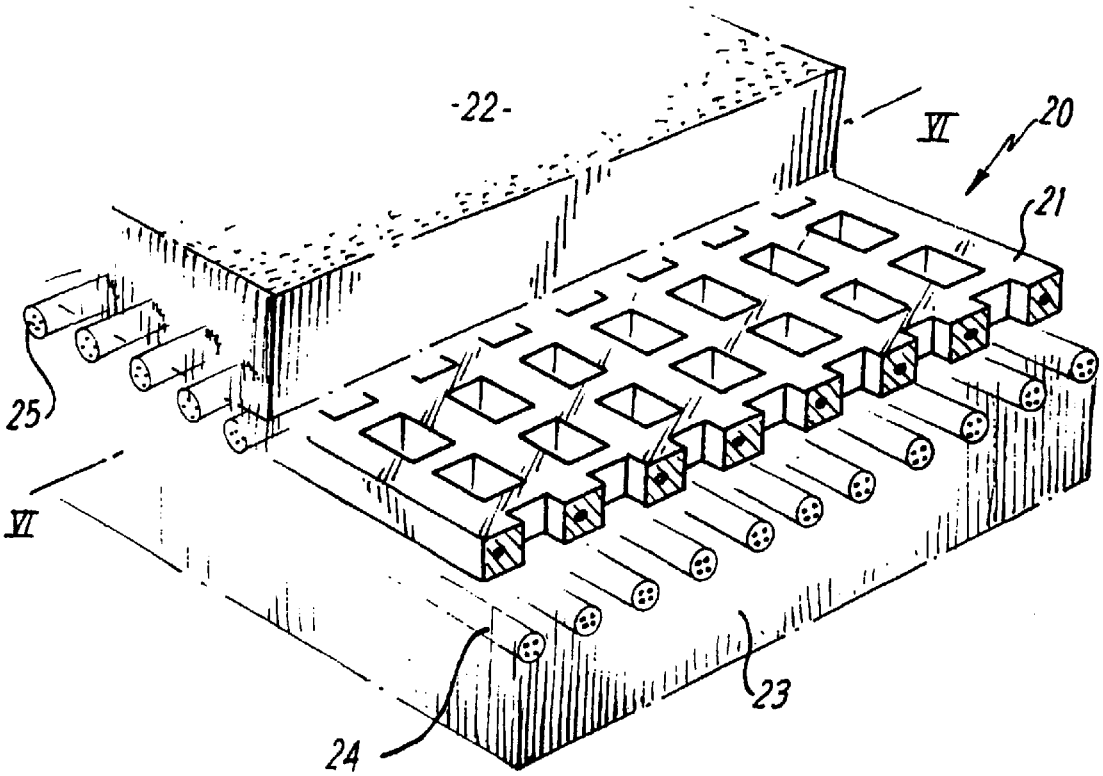
FIG. 5 is a perspective view of a third fabric in accordance with the invention.
Figure 6:
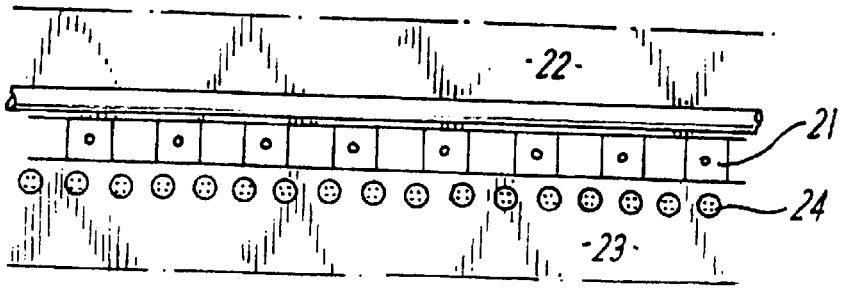
FIG. 6 is a transverse section along the line VI—VI of FIG. 5.

Referring to FIGS. 5 and 6 a third embodiment 20 of the invention is illustrated. Here the base cloth comprises a moulded mesh membrane 21 which is manufactured from thermoplastics material, similar to that previously described with reference to FIG. 1. A batt of staple fibre material is provided at both the top 22 and bottom 23 of this mesh membrane 21. An array of machine direction yarns 24 is provided in the bottom batt layer 23. An array of cross machine direction yarns 25 is provided in the top mesh membrane layer. In both arrays the yarns are 2×30.2 mm diameter PA6 monofilament twisted yarns with a linear density of 90 yams per 100 mm. The batt staple fibre is 17 dtex PA6. The total batt staple fibre weight in the fabric is 1700 $g/m^2$ (gsm).

It is to be understood that the above described embodiments are by way of illustration only. Many modifications and variations are possible.

What is claimed is:

1. Papermachine clothing comprising a base cloth and a batt fibre layer, said base cloth comprising, a molded thermoplastic mesh membrane, wherein said batt fibre layer contains a non-woven array of yarns extending in the intended machine direction of the papermachine clothing.

2. Papermachine clothing as claimed in claim 1, wherein the batt fibre layer is secured to the base fabric by needling.

3. Papermachine clothing as claimed in claim 1, wherein at least some of the said yarns of the non woven array are not crimped.

4. Papermachine clothing as claimed claim 1, wherein the said yarns of the non woven array are at least partially encapsulated in polymer.

5. Papermachine clothing as claimed in claim 1, wherein the said yarns of the non-woven array are at least partially encapsulated in at least one of the following: polyurethane; polyester; copolyester; polyamide; copolyamide; silicone and thermoplastic elastomer.

6. Papermachine clothing as claimed in claim 1, wherein the weight of the batt layer is in the range from 300 to 800 $g/m^2$.

7. Papermachine clothing as claimed in claim 1, wherein the dtex range of the batt fibres is ideally in the range from 3 to 70 dtex.

8. Papermachine clothing as claimed in claim 1, wherein the base cloth further comprises woven material.

9. Papermachine clothing as claimed in claim 1, wherein the mesh of the base cloth contains reinforcing yarns extending in at least one common direction.

10. Papermachine clothing as claimed in claim 1, wherein a second non woven array of yams is provided in a batt fibre layer, the non woven array of yams extending in the intended cross machine direction of the papermachine clothing.

11. Papermachine clothing as claimed in claim 1, wherein the said yarns of the non-woven array are at least partially impregnated with polymer.

12. Papermachine clothing as claimed in claim 1, wherein the said yarns of the non-woven array are at least partially impregnated with at least one of the following polyurethane, polyester; copolyester; polyamide; copolyamide; silicone and thermoplastic elastomer.

13. Papermachine clothing having an intended machine direction and an intended cross machine direction substantially perpendicular to the intended machine direction, comprising a base cloth and a batt fibre layer, said base cloth including a molded thermoplastic mesh membrane, said batt layer including a batt of fibrous material and a first interlayer having a substantially parallel array of non-woven non-crimped yarns extending in the intended machine direction of the papermachine clothing.

14. The papermachine clothing as claimed in claim 13, said molded mesh membrane including reinforcing yarns extending through longitudinally extending land areas of said molded mesh membrane.

15. The papermachine clothing as claimed in claim 13, said first interlayer having a length along the intended machine direction, said substantially parallel array of non-woven non-crimped yarns of said first interlayer extending substantially the length of said first interlayer.

16. The papermachine clothing as claimed in claim 13, said batt layer further comprising a second interlayer having a substantially parallel array of non-woven yarns extending in the intended cross machine direction.

17. The papermachine clothing as claimed in claim 16, said second interlayer having a width along the intended cross machine direction, said substantially parallel array of non-woven yarns of said second interlayer extending substantially the width of said second interlayer.

18. The papermachine clothing as claimed in claim 13, wherein said substantially parallel array of non-woven non-crimped yarns is adapted to improve resistance to felt compaction.

19. Papermachine clothing comprising a base cloth and a batt fibre layer, said base cloth comprising, a molded thermoplastic mesh membrane, wherein said batt fibre layer contains a non woven array of yarns extending in the intended machine direction of the papermachine clothing and connecting members are provided between the yarns of said nonwoven array of yarns.

20. Papermachine clothing comprising a base cloth and a batt fibre layer, said base cloth comprising, a molded thermoplastic mesh membrane, wherein said batt fibre layer contains a non woven array of yarns extending in the intended machine direction of the papermachine clothing and the yarns of said non-woven array comprise twisted monofilament yarns.

* * * * *